US005135675A

United States Patent [19]

Elliott et al.

[11] Patent Number: 5,135,675

[45] Date of Patent: Aug. 4, 1992

[54] MACHINE DISHWASHING COMPOSITIONS COMPRISING ORGANIC CLAY AND SULFONATED POLYSTYRENE POLYMER OR COPOLYMER AS THICKENING AGENTS

[75] Inventors: David L. Elliott, Hawthorne; Rosemary M. Sisco, Hackensack, both of N.J.

[73] Assignee: Lever Brothers Company, Divison of Conopco, Inc., N.Y.

[21] Appl. No.: 655,224

[22] Filed: Feb. 12, 1991

Related U.S. Application Data

[63] Continuation of Ser. No. 379,403, Jul. 13, 1989, abandoned.

[51] Int. Cl.[5] ..... C11P 7/54

[52] U.S. Cl. ..... 252/103; 252/160; 252/558; 252/173; 252/174.23; 252/174.25; 252/140

[58] Field of Search ..... 252/103, 160, 558, 173, 252/174.23, 174.25, 140

[56] References Cited

U.S. PATENT DOCUMENTS

| | | | |
|---|---|---|---|
| 3,393,153 | 7/1968 | Zimmerer | 252/95 |
| 4,116,849 | 9/1978 | Leikhim | 252/103 |
| 4,116,851 | 9/1978 | Rupe | 252/103 |
| 4,416,794 | 11/1983 | Barrat et al. | 252/173 |
| 4,752,409 | 6/1988 | Drapier | 252/94 |
| 4,839,077 | 6/1989 | Cramer et al. | 252/102 |
| 4,867,896 | 9/1989 | Elliott et al. | 252/174.23 |

OTHER PUBLICATIONS

Weiss, R. A. et al., Journal of Polymer Science; Polymer Chemistry Edition, vol. 23, pp. 525-533—Attachment 1 and pp. 549-568—Attachment 2 (1985).

*Primary Examiner*—A. Lionel Clingman
*Assistant Examiner*—Bradley A. Swope
*Attorney, Agent, or Firm*—A. Kate Huffman

[57] ABSTRACT

A stable thixotropic liquid automatic dishwashing composition is disclosed. The composition may include swellable clays, synthetic water dispersible sulfonated polymers, optionally multivalent cations, builder salts, an alkaline source, a hypochlorite source, nonionic or anionic surfactants, and defoamers. The system, containing clay and sulfonated polymer, and optionally multivalent metal ions, thickens the composition to provide structure to aid in suspending finely divided solid components, while maintaining good salt tolerance, stability against hypochlorite and acceptable cup retention with shear-thinning rheological behavior.

13 Claims, No Drawings

MACHINE DISHWASHING COMPOSITIONS COMPRISING ORGANIC CLAY AND SULFONATED POLYSTYRENE POLYMER OR COPOLYMER AS THICKENING AGENTS

This is a continuation application of Ser. No. 379,403, filed Jul. 13, 1989, now abandoned.

FIELD OF THE INVENTION

This invention relates to liquid automatic dishwashing detergent compositions which are used for the purpose of cleaning soils from dishes, glasses and cookware. More particularly, it provides for such a composition containing a structuring system composed of a swellable clay, and a water-soluble sulfonated polymer, optionally a source of multivalent cations together with a hypochlorite bleach and other common automatic dishwasher detergent components.

BACKGROUND OF THE INVENTION

The use of liquid compositions for automatic home dishwashing offers several advantages over the more predominant powdered or granular forms. These advantages include greater ease of handling in dispensing and dosing, the substantial elimination of lump formation, "caking", and dust and improved solubility.

However, satisfactory liquid autodish detergent compositions must meet certain requirements. First, the composition must be a substantially uniform mixture of ingredients to deliver the optimum combination of active components to the wash with each dose. In most current formulations, this requires that the liquid be shaken before each use to remix the components. A satisfactory product should be substantially stable against physical separation and segregation of its active components or de-mixing. In addition, a high composition viscosity at a low shear rate contributes to physical stability of the liquid and protects against separation of the active components.

Physical stability can be achieved through the use of suspending or viscosifying systems to enhance the liquid rheological properties. Such systems typically maintain viscosity at low shear rate under the high ionic strength conditions present in a built liquid detergent. The agents producing these systems must also be chemically compatible with the other components of the formula, especially chlorine bleach or hypochlorite ion at the high pH where the ion is stable.

A further constraint is that the liquid dishwashing detergent must also be compatible with the dishwashing equipment presently available. Most current home dishwashing machines use detergent cups which have been designed to house powdered or granular solid detergent and deliver it to a specific wash cycle. The cups are not designed to contain low viscosity liquids. Consequently, any liquid for use as an automatic dishwashing composition or detergent must possess a sufficiently high viscosity to be effectively retained in the cup to avoid substantial leakage into the machine during cycles which precede the main wash cycle. Excessive leakage leads to under-dosing in the wash cycle and may negatively affect cleaning performance. Although high viscosity is desirable under storage conditions or while the material is in the detergent cup, the liquid must also be readily and conveniently dispensed from its container. Therefore, a liquid that undergoes a viscosity decrease under the influence of applied shear such that the decrease is reversible with time after the removal of shear, is preferable. This behavior is termed thixotropy and is desirable for liquid dishwashing detergents. Agitation of the liquid in the container, by squeezing or shaking, will supply sufficient shear strain to initiate shear-thinning behavior and increased liquid flow for dispensing from the container. Optimum flow properties allow for easily pourable liquids or fluids which maintain sufficient viscosity at higher shear rates to prevent or minimize excessive spillage. The liquid must also quickly regain its structure or viscosity after dispensing so it does not undergo substantial leakage from the dispenser cup in the machine.

Copending Patent application Ser. No. 202,087 filed 6/2/88 describes a similar dishwashing product but without sulfonated polymers. GB 2 164 350 describes a liquid automatic dishwashing product comprising a liquid phase which is water containing alkali metal tripolyphosphate, clay thickener, a chlorine bleach compound and a water-soluble polymeric carboxylic acid, for example, sodium polyacrylate. GB 2 176 495 describes clay thickened liquids stabilized by polyvalent metal salts of long chain fatty acids, for example aluminum tristearate.

U.S. Pat. No. 4,508,629 discloses the use of xanthan gum and for example, polystyrenesulfonate as a viscosifying composition for oil recovery.

Japanese patent 58 69,717 describes aqueous zeolite slurries stabilized with for example, styrenesulfonate polymers. The slurries are said to be useful in detergents.

It has been discovered that a hypochlorite containing liquid automatic dishwashing detergent composition which includes a structuring system of a swellable clay, a water-soluble synthetic sulfonated polymer, and an optional source of multivalent cations substantially minimizes the problems of the art. This combination also gives a positive effect on the rheology of the product, due, it is theorized, to interaction between the components. This positive interaction is manifested in apparent viscosity increases, at shear rates up to 450 $s^{-1}$ The art details various kinds of structuring systems containing clay, polymer, or related combinations; but these are not completely satisfactory. The increase in viscosity observed in this system together with superior hypochlorite stability further increases the desirability of the combination.

Improved rheology of the composition can result in improved detergent performance through better retention in the cup and better stability against separation which provides increased reliability in dosing the proper levels of active ingredients to the machine wash cycle. Further, the improved structuring system also results in improved product dispensability.

DETAILED DESCRIPTION OF THE INVENTION

Broadly, this invention includes:

a) a substantially stable viscosifying or structuring system of at least two and optionally three components, a swellable clay, a water-dispersible sulfonated polymer, and an optional multivalent cation. The ratio of the components is such that an enhanced rheological effect occurs with the polymer, clay, and optional multivalent metal ions in combination with hypochlorite ion at an appropriate pH;

b) a source of hypochlorite ion or chlorine bleach, such as sodium hypochlorite;

c) a mixture of customary additives such as builder salts (phosphates) alkaline sources (sodium carbonate, sodium hydroxide, sodium silicates, etc.) optional surfactant (anionic or non-ionic; preferably low-foaming), and a defoamer. The invention furthermore provides an article of manufacture comprising the composition of the invention disposed in a container with a reclosable dispensing orifice of 6 mm to 12 mm in actual length.

The positive interaction which occurs between the swelling clay and the water dispersible synthetic sulfonated polymer and optionally the multivalent cation is beneficial in that it provides an enhancement of the low shear viscosity of the liquid. Several performance advantages can be gained through the enhanced structuring offered by the combination.

The combination delivers satisfactory stability against physical separation or segregation of the liquid upon storage. This stability n many cases will be found to be an improvement upon polyacrylate/clay stabilizers or polyacrylate stabilizers alone. The improved stability provides for a more uniform product and for dosing of an optimized mixture of cleaning agents into the machine. Poor physical stability can lead to development of a stratified liquid through the separation of a fluid layer to the top of the liquid and segregation of solids to the bottom. A physically separated liquid may be remixed by the end user through vigorous shaking of the bottle but this is not completely desirable. The use of the sulfonated polymer in combination with the clay and optional multivalent metal ions provides for stability against separation and syneresis.

Detergent cup retention under wash conditions is higher with liquids possessing a higher low shear viscosity. Such retention is related to product cleaning performance since it governs the reliability of the detergent dose delivered to the wash cycle in the machine. The present invention allows for desirable rheology with lower levels of insoluble clay minerals to be used in automatic dishwashing liquid detergents. Liquids structured with clay alone can develop acceptable flow behavior if sufficient quantities of clay are used, however, the presence of insoluble clay minerals or silica negatively affects glass spotting and filming performance. The combination as described in the present invention has an advantage over a composition structured with synthetic polymers alone in that an otherwise unattainable low shear viscosity is achieved. Liquids containing, for example, polyacrylate as the only structuring agent or structurant frequently suffer from poor cup retention.

Biopolymers known to the art usually react readily with hypochlorite and such chemical instability towards hypochlorite will lead to eventual loss in viscosity of the liquid. The synthetic sulfonated polymers of the invention, on the other hand, are substantially stable. Liquids containing the polymers of the invention as structurants are at parity with polyacrylates as to their chemical and rheological stability. By using a synthetic sulfonated polymer such as sodium polystyrenesulfonate in conjunction with clay and if desired an appropriate multivalent metal cation, an acceptably good chemical stability of the structuring system is achieved due to the less reactive nature towards hypochlorite of the combination of sulfonated polymers and swelling clay.

The combination described in this invention constitutes an efficient and cost-effective structuring system. The use of the combined clay/sulfonated polymer/optional multivalent ion structuring system allows for lower quantities of clay to be used. A lower quantity of a high quality clay can be used at a moderate cost savings because the polymer and optional multivalent ion combination is less expensive than the clay. Alternatively, a less expensive clay may be tolerated because in combination with the polymer and optional multivalent ions lower concentrations of clay are required.

The structuring system of this invention can be tailored to develop an optimum fluid rheology in terms of low shear rate attributes (physical stability and cup retention) and moderate shear rate flow behavior during dispensing. Because the structuring system is composed of more than one part, the clay content can be modified independently of the polymer content and if desired, the cation concentration. Thus, the rheology of the liquid can be optimized more easily than a one or two part system.

The liquid automatic dishwashing detergent of this invention is in the form of a thixotropic slurry-like paste. The liquid cleaning agent should possess a viscosity of about 0.1 to 20 pascal seconds at 25° C. and 5 $s^{-1}$, preferably 1 to 12 pascal seconds and, most preferably 1.5 to 9, to facilitate dispensing and processing. Measurements are made using a Haake Rotovisco RV100 with a linearly increasing shear rate of 15 $sec^{-1}$/min.

The swelling clay component of the structuring system may be a clay mineral of the smectite type of 2:1 layered silicate. The clay can be naturally occurring or synthetic and can be of the dioctahedral or trioctahedral type. Examples of the natural clays that may be used in this invention are montmorillonites, hectorites, nontronites, beidillites, saponites, and sauconites. Materials of this type are available under the names of Gelwhite GP and Thixagel (trade names of Southern Clay). GK-129 from Georgia Kaolin or synthetic swelling clays such as Laponite (trade name of Laporte Industries) may also be used. The clay should preferably be in an alkali metal exchange form and should be white or most preferably of a high white purity. Peptizing agents, such as hexametaphosphate, pyrophosphate, or other polyelectrolytes known to the art may be used. The clay may be present at about 0.1 to 15%, preferably about 0.2 to 6%, and most preferably about 0.5 to 4% by weight of the final products. The use of excessive amounts of clay within the formulas which contain high levels of other solids can lead to viscosities considerably above the preferred range.

The polymer used should be of a synthetic sulfonated type and be water dispersible and, thus, soluble or partially soluble. The term "sulfonated polymer" is used to denote any polymeric material which contains a sulfonate or sulfate moiety on at least 3% of its monomer units, or which is chemically modified in any way to include in its chemical structure a significant amount of sulfonate or sulfate groups.

Generally any polymeric material may be used which contains at least 3% of its monomer units the following structure I:

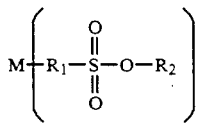

I where M is a monomer unit in a polymer, $R_1$ is oxygen, $C_{1-9}$ alkyl, aryl or alkylaryl; $R_2$ is hydrogen, $C_{1-18}$ alkyl, aryl, alkylaryl, or a metal cation having a valency of 1 to 4, preferably a valence of 2 or less, such as for example, sodium, potassium magnesium, and the like. Preferably, the polymer should also be anionic. Examples of applicable polymers are polystyrenesulfonic acid and its salts, polyvinylsulfonic acid and its salts, or poly(2-acrylamido-2-methylpropanesulfonic acid) and its salts. Partially sulfonated materials (e.g., copolymers) can be used as well if they are dispersible in aqueous solutions.

Optimum molecular weights are in the range of about 10,000 to 6 million, with about 20,000 to 1 million more preferred and about 50,000 to 750,000 most preferred. Crosslinked polymeric materials or network - forming polymeric materials can be used as well. The polymer should be present in the formulation in an amount of about 0.1 to 7%, with 0.1 to 4% being more preferred and 0.2 to 2.5% most preferred. The use of excessively high polymer concentrations can lead to gumminess and extremely high viscosities. Excessively high polymer molecular weights can produce liquids with a very stringy and pituitous flow behavior.

A third component which can be included with clay and polymer in the structuring system is a source of soluble multivalent cations, preferably employing inorganic chlorides, sulfates, and the like. Trivalent and tetravalent as well as divalent ions can be used, with the preferred choices being aluminum zinc, and tin. Aluminum is the most preferred species. The source of ions will be present in the formula from 0 to 3% by weight with 0 to 2% more preferred, and 0.01 to 1.0% most preferred. Since hypochlorite stability is critical, the metal ion employed must not substantially deleteriously affect this stability.

An alkali metal condensed phosphate may be present in the formula as a water hardness sequestering agent or builder. Tripolyphosphate is the preferred sequestrant although pyrophosphate, hexametaphosphate, or other condensed phosphates may be used. The sequestrant may be present in the formula from about 0.1 to 35% with 15 to 30% by weight being more preferred. Use of the sequestrant, such as sodium tripolyphosphate, in excess of its solubility limit within the formula requires that the solid be present as fine particles which are suspended by the structuring system. The presence of solids will affect the viscosity of the liquid and may modify the range of the structurants needed to deliver the proper rheology.

Other inorganic builders which may be used are sodium and potassium salts of polyphosphate, orthophosphate, carbonate, bicarbonate, sesquicarbonate and borate.

Organic detergent builders can also be used in the present invention. They are generally sodium and potassium salts of the following: citrate, nitrolotriacetates, phytates, polyphosphates, oxydisuccinates, oxydiacetates, carboxymethyloxy succinates, tetracarboxylate, starch and oxidized heteropolymeric polysaccharides. Sodium citrate is an especially preferred organic builder.

Water-insoluble aluminosilicate ion-exchange materials may be used as alternative builders disclosed in e.g. GB 1 473 201 and 1 473 202. These are crystalline or amorphous materials of general formula $$(Cat_2/n^O)x\ Al_2O_3(SiO_2)y.\ ZH_2O$$

wherein Cat is a cation (e.g. $Na^+$or $K^+$) having a valency n that is exchangeable with Calcium; x is a number from 0.7 to 1.5; y is a number from 1.3-4; and z is such that the bound water content is from 1% to 28% by weight. The commercially available product Zeolite type 4A is preferred.

$$Na_2O.\ Al_2O_3.\ 2SiO_2.\ 4.5H_2O$$

The sources of alkalinity are used in combination in the more preferred embodiments of this invention. An alkali metal carbonate may be used as an alkaline buffering agent from about 0.1 to 30% more preferably from 2 to 15% by weight.

Alkali metal silicates with an $SiO_2$:$Na_2O$ weight ratio of about 2.0 to 3.25 may be used as alkaline sources and as anti-corrosion agents to protect metal and china surfaces against the harshly alkaline environments present in the wash. The silicate may be used in the form of an aqueous liquor or a solid, preferably present in the formula at about 0.1 to 30 by weight, and more preferably from 5 to 25%.

An alkali metal hydroxide may be used as an alkaline source and as a means to boost the pH of the liquid detergent to a pH of 10.5 to 13 to stabilize the hypochlorite. A preferable pH range is 11 to 12.5 to optimize hypochlorite stability and consumer safety. Sodium hydroxide in the form of an aqueous liquor or as a solid will be used in the formula to achieve the above pH range, typically about 1 to 2.5% by weight, or higher, depending on the other components.

The surfactants optionally used in this invention may be those normally used in machine dishwashing products provided they are sufficiently stable with hypochlorite. These surfactantsshould be of the low-foaming type as foam interferes with the dishwasher cleaning action. While this invention is not limited to any particular surfactant or type of surfactant, the surfactant should possess stability against degradation by hypochlorite. The preferred nonionics are condensates of 8 to 12 carbon linear alcohols with polymers of ethylene oxide or propylene oxide in either a random copolymer or as block polymers provided sufficient hypochlorite stability is introduced by appropriate means, such as for example, end capping. Hypochlorite stability is enhanced in surfactants of this type which contain relatively higher propylene oxide to ethylene oxide ratios. Surfactants of these types are present in this invention at about 0.1 to 25% by weight, with from 0.1 to 5% preferred and about 0.1 to 3% most preferred.

Highly foaming surfactants are preferably excluded or are used in only minimal amounts, or if desired with effective hypochlorite stable defoaming agents. Low foaming anionic surfactants are preferred for this invention, especially in combination with effective defoamers, in that these surfactants are shown to be more stable towards hypochlorite. Anionic surfactants may be present in the composition of this invention from about 0.1 to 25% by weight, with from 0.1 to 3% preferred. Examples of these surfactants are alkyl diphenyloxide sulfonates; alkyl sulfonates; alkyl napthalene sulfonates; and nonionio surfactants as described above in which a sodium alkylene carboxylate moiety has been linked to the terminal hydroxyl group(s) through an ether bond.

Defoaming of the wash may be accomplished by the presence of any of a number of commercially available defoaming agents. These agents may be of the general type of slightly soluble alkyl carboxylates, alkyl phosphates, hydrophobic silicas, silicone defoamers, or many others. In addition to being an effective defoamer the species must be stable to hypochlorite. The defoamer will optionally be present in the composition from about 0.1 to 5% by weight, more preferably from 0.1 to 1%, and most preferably from about 0.1 to 0.5%.

Stable chlorine bleaches known to the art such as alkali metal hypochlorites, chlorine containing organics which yield available chlorine or the like may be present in the formula as agents for removing tea, coffee, and other food stains from cups, dishes, flatware, etc. The bleach source may be present in the mixture at about 0.1 to 10% by weight with the most preferred range being about 0.1 to 2%. Common bleaching agents which are well known in the art may be used. For substantially effective compositions, about 0.1 to about 2% by weight of available chlorine is desirable. Sodium, potassium, or calcium hypochlorite are preferred.

Typical stable colorants or pigments, such as $TiO_2$, fragrances and other adjuvants may be employed as desired with the provision that they must be adjusted to achieve appropriate viscosity and stability.

A summary of the preferred components in this invention is included in the following list:

| Component | Approximate Wt. % |
|---|---|
| Swellable Clay | 0.5–4% |
| Water-Soluble Sulfonated Polymer | 0.2–2.5% |
| Multivalent Ion (Optional) | 0–1% |
| Sodium Tripolyphosphate | 15–30% |
| Sodium Carbonate | 2–15% |
| Sodium Silicate (1.0–3.25 $SiO_2/Na_2O$ weight ratio) | 5–25% |
| Sodium Hypochlorite | 0.1–2% |
| Sodium Hydroxide (typically) | 1–2.5% |
| Surfactant (optional) | 0–3% |
| Defoamer (optional) | 0–0.5% |
| Adjuvants (Optional) | 0–5% |
| Water | Balance |
| | 100% |

It is to be understood that the sodium cations mentioned above can be replaced with other alkali metal cations while still achieving the benefits of this invention.

The following Examples will more fully illustrate the embodiments of this invention. All parts and proportions referred to herein and in the appended claims are by weight unless otherwise indicated.

EXAMPLE I

Three formulations of automatic dishwashing detergent liquids are given below. The procedure outlined below is for formulation (2).

| Component | Wt. % in formulation (1) | (2) | (3) |
|---|---|---|---|
| Gelwhite GP [1] | 3.0 | 3.0 | 3.0 |
| Sodium Tripolyphosphate (anhy.) | 10.0 | 10.0 | 10.0 |
| Versa TL-500 [2] | 0.0 | 8.0 | 8.0 |
| Sodium Hydroxide (50% in water) | 2.4 | 2.4 | 2.4 |
| Aluminum Sulfate .18 H2O | — | — | 1.0 |
| Sodium Silicate (2.4:1 ratio of SiO2:Na2O, 47% solids) | 17.78 | 17.78 | 17.78 |
| Sodium Carbonate | 6.0 | 6.0 | 6.0 |
| Defoamer [3] | 6.16 | 6.16 | 6.16 |
| Surfactant [4] | 0.8 | 0.8 | 0.8 |
| Sodium Tripolyphosphate (anhy.) | 10.0 | 10.0 | 10.0 |

-continued

| Component | Wt. % in formulation (1) | (2) | (3) |
|---|---|---|---|
| Sodium Hypochlorite (12.0% av. Cl) | 8.33 | 8.33 | 8.33 |
| Water (distilled) | balance | balance | balance |
| Total | 100.0 | 100.0 | 100.0 |

[1] Gelwhite GP is a trade name of Southern Clay, Inc. for a peptized sodium montmorillonite clay.

[2] Versa TL-500 is a trade name of National Starch and Chemical Co. for a poly(sodium styrenesulfonate) of molecular weight 500,000. A 25% actives solution is used in the formulation.

[3] The defoamer used in these formulations is stearyl acid phosphate available as "high mono grade" from Occidental Chemical. It is used as a 2.6 wt % dispersion in water.

[4] The surfactant is Dowfax 2A-1, which is used as a 45% actives solution. Dowfax is a trade name of Dow Chemical.

[1]Gelwhite GP is a trade name of Southern Clay, I nc. for a peptized sodium montmorillonite clay. [2]Versa TL-500 is a trade name of National Starch and Chemical Co. for a poly(sodium styrenesulfonate) of molecular weight 500,000. A 25% actives solution is used in the formulation. [3]The defoamer used in these formulations is stearyl acid phosphate available as "high mono grade" from Occidental Chemical. It is used as a 2.6 wt% dispersion in water. [4]The surfactant is Dowfax 2A-1, which is used as a 45% actives solution. Dowfax is a trade name of Dow Chemical.

The distilled water (137.65 g) was placed in a 1-liter stainless steel beaker at 20° C. Fifteen grams of Gelwhite GP was sifted slowly into the water while agitation and shear were supplied by a mechanical stirrer to form a slurry. After the slurry was uniform and smooth, it was heated to 45° C. with continued stirring. Into the slurry was added 50g of granular anhydrous sodium tripolyphosphate and after the mixture was again stirred until uniform, the temperature was increased to 55° C. Next, 40g of a 25% aqueous solution of Versa TL-500 was added to the slurry, followed by 12g of 50% sodium hydroxide solution. The slurry was then stirred for about 5 minutes. The remaining ingredients were added to the slurry with enhanced mixing in the order listed in formulation 2, with 5–10 minutes between each addition: 88.9g of 47 wt% sodium silicate solution; 30g of sodium carbonate; 30.8g of a 2.6 wt% premix of stearyl acid phosphate in water; 4.0g of Dowfax 2A-1 surfactant (45% actives) and an additional 50g of granular anhydrous sodium tripolyphosphate. The mixture was stirred until homogeneous.

The mixture was then cooled to 30° C. and 41.65 g of sodium hypochlorite solution (12% available Cl) was added. The slurry was stirred for about 5 minutes to complete mixing.

The resulting automatic dishwashing detergent is an opaque thixotropic liquid which is off-white in color. It has a solution pH of about 12. The viscosity data was collected at 25° C. using a Haake Rotovisco RV100. The measurements were taken at a uniformly increasing shear rate of about $15s^{-1}$ minute. The formulations were tested 7 days after mixing and the results are shown in Table 1. Formulation (1) containing only clay is included for comparative purposes to demonstrate the enhancement provided by combinations of clay and polymer.

TABLE 1

Rheological Comparison of the Formulations: Viscosity at 25° C. as Measured in Pascal Seconds

| | (1) | (2) | (3) |
|---|---|---|---|
| $5\ s^{-1}$ | 5.2 | 7.5 | 11.1 |

-continued

| Rheological Comparison of the Formulations: Viscosity at 25° C. as Measured in Pascal Seconds | | | |
|---|---|---|---|
| | (1) | (2) | (3) |
| 21 $s^{-1}$ | 1.6 | 1.8 | 2.6 |

Addition of polymer and polymer with metal ion results in higher viscosity in these formulations over the clay alone.

EXAMPLE II

The following formulations are prepared in a manner similar to that of Example I.

| | Wt % in Formulation | | |
|---|---|---|---|
| Component | (4) | (5) | (6) |
| Gelwhite GP [1] | 3.0 | 3.0 | 3.0 |
| Sodium Tripolyphosphate | 10.0 | 10.0 | 10.0 |
| Sulfonated Polymer [2] | | | |
| Versa TL-126 | 6.7 | — | — |
| Versa TL-502 | — | 8.0 | — |
| HSP 1180 | — | — | 13.3 |
| Sodium Hydroxide (50%) | 2.4 | 2.4 | 2.4 |
| Aluminum Sulfate .18 H2O | 0.5 | — | — |
| Sodium Silicate (see Ex. 1) | 17.78 | 17.78 | 17.78 |
| Sodium Carbonate | 6.0 | 6.0 | 6.0 |
| Defoamer [3] | 6.16 | 6.16 | 6.16 |
| Surfactant [4] | 0.8 | 0.8 | 0.8 |
| Sodium Tripolyphosphate | 10.0 | 10.0 | 10.0 |
| Sodium Hypochlorite (12%) | 8.33 | 8.33 | 8.33 |
| Deionized Water | | balance | |
| Total | 100.0 | 100.0 | 100.0 |

[1] Gelwhite GP is a trade name of Southern Clay, Inc. for a peptized sodium montmorillonite clay.
[2] Versa Tl-126 and -502 are trade names of National Starch and Chemical Co. for poly(sodium styrenesulfonates) of molecular weight 120,000 and 500,000 respectively. HSP 1180 is a trade name of Henkel, Inc. for a homopolymer of poly(2-acrylamido-2-methylpropanesulfonic acid) of molecular weight 200,000. Versa TL 126 is used in the form of a 30% actives solution: Versa TL 502 is used in the form of a 25% actives solution and HSP 1180 is used as a 15% actives solution.
[3] The defoamer used in these fromulations is stearyl acid phosphate available as "high mono grade" from Occidental Chemical. A 2.6 wt % dispersion in water is used.
[4] The surfactant used is Dowfax 2A-1 which is a trade name of Dow Chemical. The surfactant is used as a 45% actives solution.

Table 2 shows viscosities for these formulations at one day. The slurries are similar in appearance and property to those in Example I, with variations in viscosities caused by differences in polymer type and molecular weight.

TABLE 2

| FORMULATION VISCOSITY Viscosity at 25° C. at 5 $s^{-1}$ Measured in Pascal-seconds (Day 1) | | | |
|---|---|---|---|
| (1) | (4) | (5) | (6) |
| 5.2 | 8.1 | 7.6 | 19.4 |

From a comparison with Formulation 1 an increase in viscosity is observed upon addition of the polymer into the thickening system.

Table 3 shows the chlorine stability of representative formulations from Example II over a 4-week period—control samples containing all of the ingredients of Formulation (1) but with the omission of the sulfonated polymer and the addition of Clay and Clay/Polyacrylate are given for comparison. The results indicate that the hypochlorite stability of formulations (4) through (6) is not decreased significantly by the presence of the sulfonate polymers. Polyacrylates are generally considered to have acceptable stability towards chlorine. The sulfonated polymers of the invention match the polyacrylate stability.

TABLE 3

| CHLORINE STABILITY at 25° C. | % Available Chlorine (days) | | | | |
|---|---|---|---|---|---|
| Formulation | 1 | 7 | 14 | 21 | 28 |
| (4) | 1.01 | 1.00 | 0.99 | 0.95 | 0.92 |
| (5) | 1.04 | 0.99 | 0.99 | 0.95 | 0.92 |
| (6) | 1.00 | 1.00 | 1.03 | 1.01 | 0.99 |
| Comparative | | | | | |
| Clay (Gelwhite GP) | 1.00 | 1.00 | 0.98 | 0 97 | 0.94 |
| Clay/Polyacrylate* | 1.00 | 1.00 | 0.95 | 0.92 | 0.90 |

*1% Acrysol A-3 (ex Rohm and Haas)

Table 4 lists viscosity (at 5 $s^{-1}$) and appearance of formulations(5) and (6) over a 4-week period to demonstrate that their physical stability is adequate for storage conditions.

TABLE 4

| STABILITY | Viscosity (Pa s) (5 $s^{-1}$) | | | | |
|---|---|---|---|---|---|
| Formulation | 7 | 14 | 21 | 28 (days) | Syneresis (28 days) |
| (5) | 4.9 | 4.6 | 4.9 | 3.8 | slight 0–1.0% |
| (6) | 6.6 | 8.0 | 6.7 | 7.2 | slight 0–1.0% |
| 3% clay (Gelwhite) | 5.0 | 4.8 | 4.5 | 4.5 | heavy > 2% |

Syneresis:
slight denotes supernatant < 1%;
heavy > 2%

Formulations (5) and (6) have more stable viscosities over a 4 week period than the samples thickened with only clay, while the presence of the polymer formulations (5) and (6) reduces measurable syneresis compared to the clay thickened sample.

EXAMPLE III

The following formulations are prepared in a manner similar to that of Example I. the autodish liquid formulations are made with water soluble sulfonated polystyrene copolymers. Formulation (7) is a comparative example based on cleaning compositions taught in GB 2,176,495A.

| | % Actives | | | |
|---|---|---|---|---|
| Component | (7) | (8) | (9) | (10) |
| Swellable clay | 3.0% | 3.0 | 3.0 | 3.0 |
| Aluminum stearate | 0.05–0.5 | — | — | — |
| Sulfonated 40/60 styrene MMA [1] | — | 0.1–2.0 | — | — |
| 70/30 [2] | — | — | 0.1–2.0 | — |
| 85/15 [3] | — | — | — | 0.1–2.0 |
| Sodium hydroxide (50% w/w) | 1.40 | 1.4 | 1.4 | 1.4 |
| Defoamer [4] | 0–0.5 | 0–0.5 | 0–0.5 | 0–0.5 |
| Sodium silicate | 15.00 | 15.00 | 15.00 | 15.00 |
| Sodium carbonate | 6.00 | 6.00 | 6.00 | 6.00 |

-continued

| Component | % Actives (7) | (8) | (9) | (10) |
|---|---|---|---|---|
| Sodium tripolyphosphate | 16.00 | 16.00 | 16.00 | 16.00 |
| Sodium hypochlorite | 1.00 | 1.00 | 1.00 | 1.00 |
| water | balance | balance | balance | balance |
| | 100% | 100% | 100% | 100% |

[1] A copolymer containing 40% sodium styrenesulfonate units and 60% methyl methacrylate units having a molecular weight of 100,000.
[2] A copolymer containing 70% sodium styrenesulfonate units and 30% methyl methacrylate units having a molecular weight of 100,000.
[3] A copolymer containing 85% sodium styrenesulfonate units and 15% methyl methacrylate units and having a molecular weight of 100,000.
[4] The defoamer used in these formulations is stearyl acid phosphate available as "high mono grade" from Occidental Chemical. It is used as a 2.6 wt % dispersion in water.

Table 5 compares the structuring stability after thirty days, using the percentage of syneresis. The percent syneresis is the ratio of the measured height of the supernatant liquid layer to the total height of the sample x 100 when the samples are placed in 16 oz. plastic containers. Table 5 illustrates the reduction in syneresis observed when the polymers of the invention are included in the formulation. Formula 7 containing aluminum stearate is not as effective.

TABLE 5

| % SYNERESIS IN THIRTY DAYS (7) | (8) | (9) | (10) |
|---|---|---|---|
| 1.1% | 0.6 | 0 | 0.9 |

Table 6 describes the viscosity retention of each slurry. Viscosity measurements were made on the Haake RV 100 rheometer and given in Pascal seconds at 17s-1 All samples were stored and measure at 25° C. during the test period.

TABLE 6

| VISCOSITY AT $17s^{-1}$ (Pascal seconds) | (7) | (8) | (9) | (10) |
|---|---|---|---|---|
| DAY 1 | 1.6 | 2.3 | 2.7 | 1.6 |
| DAY 30 | 1.6 | 2.2 | 2.6 | 1.7 |

Good stability is found in all of the samples with no significant viscosity loss over thirty days.

This invention has been described with respect to certain preferred embodiments, and various modifications and variations in the light thereof will be suggested to persons skilled in the art and are to be included within the spirit and purview of this application and the scope of the appended claims.

What is claimed is:

1. An aqueous based fluid automatic dishwashing composition comprising:

(a) a thickening system comprising a water soluble polystyrene sulfonated polymer or a polystyrene sulfonated copolymer, the polymer or copolymer having an acid number of greater than about 120, a swellable clay, and optionally a water soluble multivalent cation;

(b) a sufficient level of a source of available chlorine to produce at least about 0.5% thereof;

(c) a sufficient amount of an alkaline source to produce a pH of at least about 10.5; and (d) a builder;

said composition being characterized by exhibiting thixotropic behavior, by having a viscosity of at least 0.1 to 20 pascal seconds at 25° C. and 5 $s^{-1}$, and having an available chlorine level of at least about 0.5% by weight after about six weeks storage at 25° C.

2. A composition as defined in claim 1 wherein said copolymer is a water soluble copolymer of styrenesulfonic acid or salts thereof and a $C_{1-18}$ alkyl ester of acrylic or methacrylic acid.

3. A composition as defined in claim 1 wherein said clay is selected from the group consisting of montmorillonites, hectorites, nontronites, beidillites, saponites, sauconites and mixtures thereof.

4. A composition as defined in claim 1 wherein said optional multivalent cation is selected from the group consisting of $Al^{+3}$, $Zn^{+2}$, $Sn^{+4}$ and mixtures thereof.

5. A composition as defined in claim 1 wherein said source of available chlorine is alkali metal or alkaline earth metal hypochlorites.

6. A composition as defined in claim 1 wherein said alkaline source is selected from the group consisting of alkali or alkaline earth metal hydroxides, alkali metal silicates and mixtures thereof.

7. A composition as defined in claim 1 wherein said builder is selected from the group consisting of alkali metal phosphate alkali metal carbonate and mixtures thereof.

8. A method for cleaning dishes comprising contacting said dishes with a 0.1% to 1.0% aqueous solution of the composition of claim 1.

9. An article of manufacture comprising the composition of claim 1 disposed in a container with a reclosable dispensing orifice of 6 mm to 12 mm in axial length.

10. A composition as defined in claim 1 which comprises an amount of up to 3% by weight of a source of the water-soluble multivalent cation.

11. A composition as defined in claim 10 wherein said multivalent cation is selected from the group consisting of $Al^{+3}$, $Zn^{+2}$, $Sn^{+4}$ and mixtures thereof.

12. A composition as defined in claim 11 wherein the source of the aluminum zinc or tin ions is a chloride or sulphate salt thereof.

13. A composition according to claim 10 wherein the source of the aluminum zinc and tin ions is a present in an amount of from 0.01 to 1% by weight of the composition.

* * * * *